US010400337B2

(12) United States Patent
Sudour et al.

(10) Patent No.: US 10,400,337 B2
(45) Date of Patent: Sep. 3, 2019

(54) ZIRCONIUM PRETREATMENT COMPOSITIONS CONTAINING LITHIUM, ASSOCIATED METHODS FOR TREATING METAL SUBSTRATES, AND RELATED COATED METAL SUBSTRATES

(71) Applicant: PPG Industries Ohio, Inc., Cleveland, OH (US)

(72) Inventors: Michel Sudour, Sebourg (FR); Aline Wozniak, Marly (FR); Philippe Maintier, Jenlain (FR)

(73) Assignee: PPG Industries Ohio, Inc., Cleveland, OH (US)

( * ) Notice: Subject to any disclaimer, the term of this patent is extended or adjusted under 35 U.S.C. 154(b) by 457 days.

(21) Appl. No.: 14/424,809

(22) PCT Filed: Aug. 16, 2013

(86) PCT No.: PCT/US2013/055350

§ 371 (c)(1),
(2) Date: Feb. 27, 2015

(87) PCT Pub. No.: WO2014/035690

PCT Pub. Date: Mar. 6, 2014

(65) Prior Publication Data

US 2015/0232996 A1 Aug. 20, 2015

(30) Foreign Application Priority Data

Aug. 29, 2012 (FR) ..... 12 58079

(51) Int. Cl.

| | |
|---|---|
| ***C23C 22/34*** | (2006.01) |
| ***C23C 22/73*** | (2006.01) |
| ***C25D 13/02*** | (2006.01) |
| ***C25D 13/20*** | (2006.01) |
| ***C23C 22/44*** | (2006.01) |
| ***C23C 22/83*** | (2006.01) |

(52) U.S. Cl.

CPC ..... *C23C 22/34* (2013.01); *C23C 22/44* (2013.01); *C23C 22/73* (2013.01); *C23C 22/83* (2013.01); *C25D 13/02* (2013.01); *C25D 13/20* (2013.01); *Y10T 428/12806* (2015.01)

(58) Field of Classification Search

None

See application file for complete search history.

(56) References Cited

U.S. PATENT DOCUMENTS

| | | | |
|---|---|---|---|
| 400,101 | A | 3/1889 | McLemore et al. |
| 3,455,806 | A | 7/1969 | Spoor et al. |
| 3,635,826 | A | 1/1972 | Hamilton |
| 3,663,389 | A | 5/1972 | Koral et al. |
| 3,749,657 | A | 7/1973 | Le Bras et al. |
| 3,793,278 | A | 2/1974 | De Bona |
| 3,912,548 | A | 10/1975 | Faigen |
| 3,928,157 | A | 12/1975 | Suematsu et al. |
| 3,947,338 | A | 3/1976 | Jerabek et al. |
| 3,947,339 | A | 3/1976 | Jerabek et al. |
| 3,962,165 | A | 6/1976 | Bosso et al. |
| 3,975,346 | A | 8/1976 | Bosso et al. |
| 3,984,299 | A | 10/1976 | Jerabek |
| 3,984,922 | A | 10/1976 | Rosen |
| 4,001,101 | A | 1/1977 | Bosso et al. |
| 4,009,115 | A | 2/1977 | Binns |
| 4,063,969 | A | 12/1977 | Howell, Jr. |
| 4,116,900 | A | 9/1978 | Belanger |
| 4,134,866 | A | 1/1979 | Tominaga et al. |
| 4,134,932 | A | 1/1979 | Kempter et al. |
| 4,148,670 | A | 4/1979 | Kelly |
| 4,238,594 | A | 12/1980 | Pampouchidis |
| 4,264,378 | A | 4/1981 | Oppen et al. |
| 4,273,592 | A | 6/1981 | Kelly |
| 4,313,769 | A | 2/1982 | Frelin et al. |
| 4,370,177 | A | 1/1983 | Frelin et al. |
| 4,668,421 | A | 5/1987 | Dollman |
| 4,728,456 | A | 3/1988 | Yamasoe et al. |
| 5,080,814 | A | 1/1992 | Awad |
| 5,104,577 | A | 4/1992 | Ikeda et al. |
| 5,149,382 | A | 9/1992 | Gray |
| 5,209,788 | A | 5/1993 | McMillen et al. |
| 5,328,525 | A | 7/1994 | Musingo et al. |
| 5,342,456 | A | 8/1994 | Dolan |

(Continued)

FOREIGN PATENT DOCUMENTS

| | | |
|---|---|---|
| AU | 6824265 | 6/1967 |
| AU | 414485 B2 | 7/1971 |

(Continued)

OTHER PUBLICATIONS

General Motors Corporation, "Scab Corrosion Creepback of Paint Systems on Metal Substrates", General Motors Engineering Standards, Mar. 1998, 2 pages, GM9511P.

Faler et al., U.S. Appl. No. 60/482,167 "Aqueous Dispersions of Microparticles Having a Nanoparticulate Phase and Coating Compositions Containing the Same", Jun. 24, 2003, 70 pages, PPG Industries Ohio, Inc.

Faler et al., U.S. Appl. No. 10/876,031 "Aqueous Dispersions of Microparticles Having a Nanoparticulate Phase and Coating Compositions Containing the Same", Jun. 24, 2004, 101 pages, PPG Industries Ohio, Inc.

(Continued)

*Primary Examiner* — Colin W. Slifka

(74) *Attorney, Agent, or Firm* — Alicia M. Passerin, Esq

(57) ABSTRACT

Disclosed are pretreatment compositions and associated methods for treating metal substrates with pretreatment compositions, including ferrous substrates, such as cold rolled steel and electrogalvanized steel. The pretreatment composition includes: a Group IIIB and/or IVB metal; free fluoride; and lithium. The methods include contacting the metal substrates with the pretreatment composition.

41 Claims, No Drawings

(56) References Cited

U.S. PATENT DOCUMENTS

| | | | | |
|---|---|---|---|---|
| 5,344,504 | A | 9/1994 | Deck et al. | |
| 5,441,580 | A | 8/1995 | Tomlinson | |
| 5,449,414 | A | 9/1995 | Dolan | |
| 5,449,415 | A | 9/1995 | Dolan | |
| 5,584,946 | A | 12/1996 | Karmaschek et al. | |
| 5,641,542 | A | 6/1997 | Melzer et al. | |
| 5,653,823 | A | 8/1997 | McMillen et al. | |
| 5,662,746 | A | 9/1997 | Affinito | |
| 5,700,334 | A | 12/1997 | Ishii et al. | |
| 5,759,244 | A | 6/1998 | Tomlinson | |
| 5,952,049 | A | 9/1999 | Tomlinson | |
| 5,962,145 | A | 10/1999 | Matsukawa | |
| 5,985,047 | A | 11/1999 | Buxton et al. | |
| 6,083,309 | A | 7/2000 | Tomlinson | |
| 6,168,868 | B1 | 1/2001 | Hauser et al. | |
| 6,287,394 | B1 | 9/2001 | Buxton et al. | |
| 6,432,224 | B1 * | 8/2002 | Minevski | C23C 22/66 148/272 |
| 6,447,662 | B1 | 9/2002 | Brouwer et al. | |
| 6,616,868 | B1 | 9/2003 | Gotoh et al. | |
| 6,749,694 | B2 | 6/2004 | Greene et al. | |
| 6,753,039 | B2 | 6/2004 | Heimann et al. | |
| 6,797,387 | B2 | 9/2004 | Ambrose et al. | |
| 6,875,800 | B2 | 4/2005 | Vanier et al. | |
| 6,894,086 | B2 | 5/2005 | Munro et al. | |
| 7,204,871 | B2 | 4/2007 | Holden | |
| 7,250,076 | B2 | 7/2007 | Maze et al. | |
| 7,291,402 | B2 | 11/2007 | Kazuhisa et al. | |
| 7,294,362 | B2 | 11/2007 | Tanaka et al. | |
| 7,432,333 | B2 | 10/2008 | Duffy et al. | |
| 7,470,752 | B2 | 12/2008 | Duffy et al. | |
| 7,531,051 | B2 | 5/2009 | Nakayama et al. | |
| 7,605,194 | B2 | 10/2009 | Ferencz et al. | |
| 7,612,124 | B2 | 11/2009 | Polk et al. | |
| 7,615,257 | B2 | 11/2009 | Jung et al. | |
| 7,635,727 | B2 | 12/2009 | Faler et al. | |
| 7,671,109 | B2 | 3/2010 | Cheng et al. | |
| 7,695,771 | B2 | 4/2010 | Ostrovsky | |
| 7,736,730 | B2 | 6/2010 | Jung et al. | |
| 7,745,514 | B2 | 6/2010 | Cheng et al. | |
| 7,749,368 | B2 | 7/2010 | McMurdie et al. | |
| 7,754,786 | B2 | 7/2010 | Ferencz et al. | |
| 7,819,989 | B2 | 10/2010 | Ishikura et al. | |
| 7,879,157 | B2 | 2/2011 | Drexler | |
| 8,097,093 | B2 | 1/2012 | Brent et al. | |
| 8,153,344 | B2 | 4/2012 | Faler et al. | |
| 8,557,895 | B2 | 10/2013 | Ferencz et al. | |
| 2002/0179189 | A1 | 12/2002 | Homma et al. | |
| 2004/0009300 | A1 | 1/2004 | Shimakura et al. | |
| 2004/0020564 | A1 | 2/2004 | Schenzle et al. | |
| 2004/0020567 | A1 | 2/2004 | Baldwin | |
| 2004/0144451 | A1 | 7/2004 | Matsukawa et al. | |
| 2004/0163736 | A1 | 8/2004 | Matsukawa et al. | |
| 2004/0167266 | A1 | 8/2004 | Hasegawa et al. | |
| 2004/0187967 | A1 | 9/2004 | Matsukawa et al. | |
| 2004/0244875 | A1 | 12/2004 | Yasuda et al. | |
| 2005/0252578 | A1 | 11/2005 | Tarlowski et al. | |
| 2005/0287348 | A1 | 12/2005 | Faler et al. | |
| 2006/0173099 | A1 | 8/2006 | Jueptner et al. | |
| 2006/0185769 | A1 | 8/2006 | Nakayama et al. | |
| 2006/0251896 | A1 | 11/2006 | Ferencz et al. | |
| 2007/0017602 | A1 | 1/2007 | Koch et al. | |
| 2007/0122701 | A1 | 5/2007 | Yamaguchi | |
| 2007/0272900 | A1 | 11/2007 | Yoshida et al. | |
| 2008/0008902 | A1 * | 1/2008 | Takakuwa | C09D 5/084 428/639 |
| 2008/0112909 | A1 | 5/2008 | Faler et al. | |
| 2008/0145678 | A1 | 6/2008 | McMurdie et al. | |
| 2008/0280046 | A1 | 11/2008 | Bryden et al. | |
| 2009/0032144 | A1 * | 2/2009 | McMillen | C09D 1/00 148/247 |
| 2009/0214883 | A1 | 8/2009 | De Zeeuw et al. | |
| 2009/0326098 | A1 | 12/2009 | Ferencz et al. | |
| 2010/0159258 | A1 | 6/2010 | Rakiewicz et al. | |
| 2010/0167066 | A1 | 7/2010 | Yoo et al. | |
| 2010/0170594 | A1 | 7/2010 | Inbe et al. | |
| 2010/0176000 | A1 | 7/2010 | Inbe et al. | |
| 2010/0243108 | A1 | 9/2010 | Karabin et al. | |
| 2010/0291307 | A1 | 11/2010 | McGee et al. | |
| 2010/0314004 | A1 | 12/2010 | Manavbasi | |
| 2011/0024298 | A1 | 2/2011 | Nishiguchi et al. | |
| 2011/0062026 | A1 | 3/2011 | Nishiguchi et al. | |
| 2011/0132497 | A1 | 6/2011 | Greber | |
| 2012/0018053 | A1 | 1/2012 | Nagaya et al. | |
| 2012/0076940 | A1 | 3/2012 | Brent et al. | |

FOREIGN PATENT DOCUMENTS

| | | | |
|---|---|---|---|
| CA | 2087352 | A1 | 1/1994 |
| CN | 1814860 | A | 8/2006 |
| CN | 101048476 | A | 10/2007 |
| CN | 101285184 | A | 10/2008 |
| CN | 101400826 | A | 4/2009 |
| CN | 101560655 | A | 10/2009 |
| CN | 101736336 | A | 6/2010 |
| CN | 101603174 | B | 12/2010 |
| CN | 101701336 | B | 4/2011 |
| CN | 102199766 | A | 9/2011 |
| CN | 101376958 | B | 1/2012 |
| CN | 102666922 | A | 9/2012 |
| DE | 2707405 | B2 | 9/1982 |
| DE | 19854091 | A1 | 5/2000 |
| DE | 10030462 | A1 | 1/2002 |
| DE | 102007001653 | A1 | 7/2008 |
| DE | 102009045762 | A1 | 4/2011 |
| DE | 102010033082 | A1 | 4/2011 |
| DE | 102009047523 | A1 | 6/2011 |
| EP | 0012463 | A1 | 11/1979 |
| EP | 0700452 | B1 | 7/1997 |
| EP | 0723602 | B1 | 4/1999 |
| EP | 0804633 | B1 | 2/2002 |
| EP | 1242193 | B1 | 8/2003 |
| EP | 1200641 | B1 | 12/2003 |
| EP | 1394277 | A1 | 3/2004 |
| EP | 1405933 | A1 | 4/2004 |
| EP | 1571237 | A1 | 7/2005 |
| EP | 1688515 | A1 | 8/2006 |
| EP | 1703000 | A1 | 9/2006 |
| EP | 1658392 | B1 | 3/2007 |
| EP | 1780312 | A1 | 5/2007 |
| EP | 1887105 | A1 | 2/2008 |
| EP | 1489198 | B1 | 4/2008 |
| EP | 1547721 | B1 | 8/2008 |
| EP | 1027170 | B1 | 11/2008 |
| EP | 1646735 | B1 | 11/2008 |
| EP | 1994203 | A1 | 11/2008 |
| EP | 1493498 | B1 | 6/2009 |
| EP | 2067882 | A1 | 6/2009 |
| EP | 2100986 | A1 | 9/2009 |
| EP | 2110461 | A1 | 10/2009 |
| EP | 2243863 | A1 | 10/2010 |
| EP | 2280094 | A1 | 2/2011 |
| EP | 2287358 | A1 | 2/2011 |
| EP | 2302096 | A2 | 3/2011 |
| EP | 2217742 | B1 | 5/2011 |
| EP | 1531012 | B1 | 7/2011 |
| EP | 2439310 | A1 | 4/2012 |
| EP | 1978131 | B1 | 6/2012 |
| EP | 2243863 | B1 | 6/2012 |
| EP | 2460906 | A1 | 6/2012 |
| EP | 2475468 | A1 | 7/2012 |
| EP | 2094880 | B1 | 9/2012 |
| EP | 2004874 | B1 | 6/2013 |
| EP | 1455001 | B1 | 9/2013 |
| EP | 1433875 | B1 | 11/2013 |
| EP | 1368507 | B1 | 3/2014 |
| EP | 1957692 | B1 | 6/2014 |
| EP | 2302097 | B1 | 11/2014 |
| EP | 1566467 | B1 | 3/2015 |
| EP | 2318566 | B1 | 3/2015 |
| EP | 2255026 | B1 | 5/2015 |
| EP | 2459770 | B1 | 5/2015 |
| EP | 2188415 | B1 | 9/2015 |
| GB | 1507816 | | 2/1977 |

(56) References Cited

FOREIGN PATENT DOCUMENTS

| | | | |
|---|---|---|---|
| GB | 2259920 | A | 3/1993 |
| JP | 07126859 | A | 5/1995 |
| JP | 10176281 | A | 6/1998 |
| JP | 2968118 | B2 | 10/1999 |
| JP | 2974518 | B2 | 11/1999 |
| JP | 2000199074 | A | 7/2000 |
| JP | 3278475 | B2 | 4/2002 |
| JP | 2003105555 | A | 4/2003 |
| JP | 2003226982 | A | 8/2003 |
| JP | 2004051725 | A | 2/2004 |
| JP | 2004052056 | A | 2/2004 |
| JP | 2004052057 | A | 2/2004 |
| JP | 2004068067 | A | 3/2004 |
| JP | 2004068068 | A | 3/2004 |
| JP | 2004183015 | A1 | 7/2004 |
| JP | 2004238638 | A | 8/2004 |
| JP | 2004263252 | A | 9/2004 |
| JP | 2004263280 | A | 9/2004 |
| JP | 2004331941 | A | 11/2004 |
| JP | 2005264230 | A | 9/2005 |
| JP | 2006255540 | A | 9/2006 |
| JP | 2006328445 | A | 12/2006 |
| JP | 2006342419 | A | 12/2006 |
| JP | 2007177314 | A | 7/2007 |
| JP | 2008000910 | A | 1/2008 |
| JP | 4099218 | B2 | 6/2008 |
| JP | 2008163364 | A | 7/2008 |
| JP | 4167046 | B2 | 10/2008 |
| JP | 2008240042 | A | 10/2008 |
| JP | 4223313 | B2 | 2/2009 |
| JP | 2009114500 | A | 5/2009 |
| JP | 2009174010 | A | 8/2009 |
| JP | 2009174011 | A | 8/2009 |
| JP | 2009209391 | A | 9/2009 |
| JP | 2009248460 | A | 10/2009 |
| JP | 2009249690 | A | 10/2009 |
| JP | 2009280887 | A | 12/2009 |
| JP | 2009280889 | A | 12/2009 |
| JP | 2009287078 | A | 12/2009 |
| JP | 2009287079 | A | 12/2009 |
| JP | 2009287080 | A | 12/2009 |
| JP | 4521010 | B2 | 8/2010 |
| JP | 4534592 | B2 | 9/2010 |
| JP | 4579715 | B2 | 11/2010 |
| JP | 4607969 | B2 | 1/2011 |
| JP | 2011001623 | A | 1/2011 |
| JP | 2011032512 | A | 2/2011 |
| JP | 2011042834 | A | 3/2011 |
| JP | 2011067737 | A | 4/2011 |
| JP | 2011068996 | A | 4/2011 |
| JP | 2011153740 | A | 8/2011 |
| JP | 2011225967 | A | 11/2011 |
| JP | 5201916 | B2 | 6/2013 |
| JP | 5217508 | B2 | 6/2013 |
| JP | 5345874 | B2 | 11/2013 |
| JP | 5391092 | B2 | 1/2014 |
| KR | 20070069169 | A | 7/2007 |
| KR | 20100064509 | A | 6/2010 |
| RU | 2395622 | C2 | 7/2010 |
| WO | 9315154 | A1 | 8/1993 |
| WO | 9315155 | A1 | 8/1993 |
| WO | 9502660 | A1 | 1/1995 |
| WO | 9533869 | A1 | 12/1995 |
| WO | 9727001 | A1 | 7/1997 |
| WO | 9908806 | A1 | 2/1999 |
| WO | 9929927 | A1 | 6/1999 |
| WO | 9937829 | A1 | 7/1999 |
| WO | 0032351 | A2 | 6/2000 |
| WO | 0068325 | A2 | 11/2000 |
| WO | 0071626 | A1 | 11/2000 |
| WO | 0175190 | A1 | 10/2001 |
| WO | 0186016 | A2 | 11/2001 |
| WO | 0192598 | A1 | 12/2001 |
| WO | 2004020412 | A1 | 3/2004 |
| WO | 2004035861 | A1 | 4/2004 |
| WO | 2005000914 | A1 | 1/2005 |
| WO | 2006043727 | A1 | 4/2006 |
| WO | 2007080849 | A1 | 7/2007 |
| WO | 2008094193 | A2 | 8/2008 |
| WO | 2009002471 | A2 | 12/2008 |
| WO | 2009145790 | A1 | 12/2009 |
| WO | 2011013360 | A1 | 2/2011 |
| WO | 2011045423 | A1 | 4/2011 |
| WO | 2011067094 | A1 | 6/2011 |
| WO | 2011075712 | A2 | 6/2011 |
| WO | 2011090691 | A2 | 7/2011 |
| WO | 2011092079 | A1 | 8/2011 |
| WO | 2011105101 | A1 | 9/2011 |
| WO | 2011106304 | A1 | 9/2011 |
| WO | 2011145594 | A1 | 11/2011 |
| WO | 2011153518 | A1 | 12/2011 |
| WO | 2011155538 | A1 | 12/2011 |
| WO | 2012001981 | A1 | 1/2012 |
| WO | 2012003983 | A1 | 1/2012 |
| WO | 2012036200 | A1 | 3/2012 |
| WO | 2012036201 | A1 | 3/2012 |
| WO | 2012036202 | A1 | 3/2012 |
| WO | 2012036203 | A1 | 3/2012 |
| WO | 2012036204 | A1 | 3/2012 |
| WO | 2012078788 | A2 | 6/2012 |
| WO | 2014035690 | A1 | 3/2014 |

OTHER PUBLICATIONS

ASTM International, "Standard Practice for Operating Salt Spray (Fog) Apparatus", Standard, Dec. 15, 2007, 5 pages, B 117-07a, ASTM International, West Conshohocken, PA.

* cited by examiner

ZIRCONIUM PRETREATMENT COMPOSITIONS CONTAINING LITHIUM, ASSOCIATED METHODS FOR TREATING METAL SUBSTRATES, AND RELATED COATED METAL SUBSTRATES

FIELD OF THE INVENTION

The present invention relates to pretreatment compositions and methods for treating a metal substrate, including ferrous substrates such as cold rolled steel and electrogalvanized steel, or aluminum alloys. The present invention also relates to a coated metal substrate.

BACKGROUND OF THE INVENTION

The use of protective coatings on metal substrates for improved corrosion resistance and paint adhesion is common. Conventional techniques for coating such substrates include techniques that involve pretreating the metal substrate with a phosphate conversion coating and chrome-containing rinses. The use of such phosphate and/or chromate-containing compositions, however, imparts environmental and health concerns.

As a result, chromate-free and/or phosphate-free pretreatment compositions have been developed. Such compositions are generally based on chemical mixtures that react with the substrate surface and bind to it to form a protective layer. For example, pretreatment compositions based on a Group IIIB or IVB metal compound have recently become more prevalent. Such compositions often contain a source of free fluorine, i.e., fluorine that is isolated in the pretreatment composition as opposed to fluorine that is bound to another element, such as the Group IIIB or IVB metal. Free fluorine can etch the surface of the metal substrate, thereby promoting deposition of a Group IIIB or IVB metal coating. Nevertheless, the corrosion resistance capability of these pretreatment compositions has generally been significantly inferior to conventional phosphate and/or chromium containing pretreatments.

It would be desirable to provide methods for treating a metal substrate that overcome at least some of the previously described drawbacks of the prior art, including the environmental drawbacks associated with the use of chromates and/or phosphates. It also would be desirable to provide methods for treating metal substrate that imparts corrosion resistance properties that are equivalent to, or even superior to, the corrosion resistance properties imparted through the use of phosphate conversion coatings. It would also be desirable to provide related coated metal substrates.

SUMMARY OF THE INVENTION

In certain respects, the present invention is directed to a pretreatment composition for treating a metal substrate comprising: a Group IIIB and/or Group IVB metal; free fluoride; and lithium.

In still other respects, the present invention is directed to a method for treating a metal substrate comprising contacting the metal substrate with a pretreatment composition comprising a Group IIIB and/or Group IVB metal, free fluoride, and lithium.

In still other respects, the present invention is directed to a method of coating a metal substrate comprising electrophoretically depositing a coating composition onto the metal substrate, wherein the metal substrate comprises a treated surface layer comprising a Group IIIB and/or Group IVB metal, free fluoride, and lithium.

In still other respects, the present invention is directed to a pretreated metal substrate comprising a surface layer comprising a Group IVB metal, free fluoride, and lithium on at least a portion of the substrate.

In still other respects, the present invention is directed to an electrophoretically coated metal substrate comprising: a treated surface layer comprising a Group IIIB and/or Group IVB metal, free fluoride, and lithium on a surface of the metal substrate; and an electrophoretically deposited coating over at least a portion of the treated surface layer.

DETAILED DESCRIPTION

For purposes of the following detailed description, it is to be understood that the invention may assume various alternative variations and step sequences, except where expressly specified to the contrary. Moreover, other than in any operating examples, or where otherwise indicated, all numbers expressing, for example, quantities of ingredients used in the specification and claims are to be understood as being modified in all instances by the term "about". Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances.

Unless otherwise disclosed herein, as used herein, the term "substantially free" means that a particular material is not purposefully added to a composition and only is present in trace amounts or as an impurity. As used herein, the term "completely free" means that a composition does not comprise a particular material. That is, the composition comprises 0 weight percent of such material.

Certain embodiments of the pretreatment composition are directed to a pretreatment composition for treating a metal substrate comprising a Group IIIB and/or Group IVB metal, free fluoride, and lithium. In certain embodiments, the pretreatment composition may be substantially free of phosphates and/or chromates. The treatment of the metal substrate with the pretreatment composition results in improved corrosion resistance of the substrate compared to substrates that have not been pretreated with the pretreated composition without requiring phosphates or chromates. Inclusion of lithium and/or lithium in combination with molybdenum in the pretreatment composition may provide improved corrosion performance on steel and steel substrates.

Certain embodiments of the present invention are directed to compositions and methods for treating a metal substrate. Suitable metal substrates for use in the present invention include those that are often used in the assembly of automotive bodies, automotive parts, and other articles, such as small metal parts, including fasteners, i.e., nuts, bolts, screws, pins, nails, clips, buttons, and the like. Specific examples of suitable metal substrates include, but are not limited to, cold rolled steel, hot rolled steel, steel coated with zinc metal, zinc compounds, or zinc alloys, such as electrogalvanized steel, hot-dipped galvanized steel, galvanealed steel, and steel plated with zinc alloy. Also, aluminum alloys, aluminum plated steel and aluminum alloy plated steel substrates may be used. Other suitable non-ferrous metals include copper and magnesium, as well as alloys of these materials. Moreover, the metal substrate being treated by the methods of the present invention may be a cut edge of a substrate that is otherwise treated and/or coated over the rest of its surface. The metal substrate treated in accordance with the methods of the present invention may be in the form of, for example, a sheet of metal or a fabricated part.

The substrate to be treated in accordance with the methods of the present invention may first be cleaned to remove grease, dirt, or other extraneous matter. This is often done by employing mild or strong alkaline cleaners, such as are commercially available and conventionally used in metal pretreatment processes. Examples of alkaline cleaners suitable for use in the present invention include Chemkleen 163, Chemkleen 166M/C, Chemkleen 490MX, Chemkleen 2010LP, Chemkleen 166 HP, Chemkleen 166 M, Chemkleen 166 M/Chemkleen 171/11, each of which are commercially available from PPG Industries, Inc. Such cleaners are often followed and/or preceded by a water rinse.

In certain embodiments, prior to the pretreatment step, the substrate may be contacted with a pre-rinse solution. Pre-rinse solutions, in general, may utilize certain solubilized metal ions or other inorganic materials (such as phosphates or simple or complex fluorides or acids) to enhance the corrosion protection of pretreated metal substrates. Suitable non-chrome pre-rinse solutions that may be utilized in the present invention are disclosed in U.S. Patent Application No. 2010/0159258A1, assigned to PPG Industries, Inc. and herein incorporated by reference.

Certain embodiments of the present invention are directed to methods for treating a metal substrate, with or without the optional pre-rinse, that comprise contacting the metal substrate with a pretreatment composition comprising a Group IIIB and/or IVB metal. As used herein, the term "pretreatment composition" refers to a composition that, upon contact with the substrate, reacts with and chemically alters the substrate surface and binds to it to form a protective layer.

The pretreatment composition may comprise a carrier, often an aqueous medium, so that the composition is in the form of a solution or dispersion of a Group IIIB or IVB metal compound in the carrier. In these embodiments, the solution or dispersion may be brought into contact with the substrate by any of a variety of known techniques, such as dipping or immersion, spraying, intermittent spraying, dipping followed by spraying, spraying followed by dipping, brushing, or roll-coating. In certain embodiments, the solution or dispersion when applied to the metal substrate is at a temperature ranging from 60 to 185° F. (15 to85° C.). For example, the pretreatment process may be carried out at ambient or room temperature. The contact time is often from 10 seconds to 5 minutes, such as 30 seconds to 2 minutes.

As used herein, the term "Group IIIB and/or IVB metal" refers to an element that is in Group IIIB or Group IVB of the CAS Periodic Table of the Elements. Where applicable, the metal themselves may be used. In certain embodiments, Group IIIB and/or Group IVB metal compounds are used. As used herein, the term "Group IIIB and/or IVB metal compound" refers to compounds that include at least one element that is in Group IIIB or Group IVB of the CAS Period Table of the Elements.

In certain embodiments, the Group IIIB and/or IVB metal compound used in the pretreatment composition is a compound of zirconium, titanium, hafnium, yttrium, cerium, or a mixture thereof. Suitable compounds of zirconium include, but are not limited to, hexafluorozirconic acid, alkali metal and ammonium salts thereof, ammonium zirconium carbonate, zirconyl nitrate, zirconyl sulfate, zirconium carboxylates and zirconium hydroxy carboxylates, such as hydrofluorozirconic acid, zirconium acetate, zirconium oxalate, ammonium zirconium glycolate, ammonium zirconium lactate, ammonium zirconium citrate, and mixtures thereof. Suitable compounds of titanium include, but are not limited to, fluorotitanic acid and its salts. A suitable compound of hafnium includes, but is not limited to, hafnium nitrate. A suitable compound of yttrium includes, but is not limited to, yttrium nitrate. A suitable compound of cerium includes, but is not limited to, cerous nitrate.

In certain embodiments, the Group IIIB and/or IVB metal is present in the pretreatment composition in an amount of 50 to 500 parts per million ("ppm") metal, such as 75 to 250 ppm, based on the total weight of all of the ingredients in the pretreatment composition. The amount of Group IIIB and/or IVB metal in the pretreatment composition can range between the recited values inclusive of the recited values.

The pretreatment compositions also comprise free fluoride. The source of free fluoride in the pretreatment compositions of the present invention can vary. For example, in some cases, the free fluoride may derive from the Group IIIB and/or IVB metal compound used in the pretreatment composition, such as is the case, for example, with hexafluorozirconic acid. As the Group IIIB and/or IVB metal is deposited upon the metal substrate during the pretreatment process, fluorine in the hexafluorozirconic acid will become free fluoride and the level of free fluoride in the pretreatment composition will, if left unchecked, increase with time as metal is pretreated with the pretreatment composition of the present invention.

In addition, the source of free fluoride in the pretreatment compositions of the present invention may include a compound other than the Group IIIB and/or IVB metal compound. Non-limiting examples of such sources include HF, $NH_4F$, $NH_4HF_2$, NaF, and $NaHF_2$. As used herein, the term "free fluoride" refers to isolated fluoride ions. In certain embodiments, the free fluoride is present in the pretreatment composition in an amount of 5 to 250 ppm, such as 25 to 100 ppm, based on the total weight of the ingredients in the pretreatment composition. The amount of free fluoride in the pretreatment composition can range between the recited values inclusive of the recited values.

In certain embodiments, a K ratio of a compound (A) containing a Group IIIB and/or Group IVB metal in mole weight to a compound (B) containing fluorine as a supplying source of free fluoride in mole weight calculated as HF has a ratio of $K=A/B$, where $K>0.10$. In certain embodiments, $0.11<K<0.25$.

The pretreatment compositions also comprise lithium. In certain embodiments, the source of lithium used in the pretreatment composition is in the form of a salt. Suitable lithium salts are lithium nitrate, lithium sulfate, lithium fluoride, lithium chloride, lithium hydroxide, lithium carbonate, and lithium iodide. In certain embodiments, the inclusion of lithium in the pretreatment composition results in improved corrosion resistance of steel and steel substrates.

In certain embodiments, the lithium is present in the pretreatment composition in an amount of 5 to 500 ppm, such as 25 to 125 ppm, based on the total weight of the ingredients in the pretreatment composition. In certain embodiments, the lithium is present in the pretreatment composition in an amount of less than 200 ppm. The amount of lithium in the pretreatment composition can range between the recited values inclusive of the recited values.

In certain embodiments, the molar ratio of the Group IIIB and/or IVB metal to the lithium is between 100:1 and 1:100, for example, between 12:1 and 1:50.

In certain embodiments, the pretreatment compositions also comprise an electropositive metal. As used herein, the term "electropositive metal" refers to metals that are more electropositive than the metal substrate. This means that, for purposes of the present invention, the term "electropositive metal" encompasses metals that are less easily oxidized than the metal of the metal substrate that is being treated. As will be appreciated by those skilled in the art, the tendency of a metal to be oxidized is called the oxidation potential, is expressed in volts, and is measured relative to a standard hydrogen electrode, which is arbitrarily assigned an oxidation potential of zero. The oxidation potential for several elements is set forth in Table 1 below. An element is less easily oxidized than another element if it has a voltage value, E*, in the following table, that is greater than the element to which it is being compared.

TABLE 1

| Element | Half-cell reaction | Voltage, E* |
|---|---|---|
| Potassium | $K^+ + e \rightarrow K$ | −2.93 |
| Calcium | $Ca^{2+} + 2e \rightarrow Ca$ | −2.87 |
| Sodium | $Na^+ + e \rightarrow Na$ | −2.71 |
| Magnesium | $Mg^{2+} + 2e \rightarrow Mg$ | −2.37 |
| Aluminum | $Al^{3+} + 3e \rightarrow Al$ | −1.66 |
| Zinc | $Zn^{2+} + 2e \rightarrow Zn$ | −0.76 |
| Iron | $Fe^{2+} + 2e \rightarrow Fe$ | −0.44 |
| Nickel | $Ni^{2+} + 2e \rightarrow Ni$ | −0.25 |
| Tin | $Sn^{2+} + 2e \rightarrow Sn$ | −0.14 |
| Lead | $Pb^{2+} + 2e \rightarrow Pb$ | −0.13 |
| Hydrogen | $2H^+ + 2e \rightarrow H_2$ | −0.00 |
| Copper | $Cu^{2+} + 2e \rightarrow Cu$ | 0.34 |
| Mercury | $Hg_2^{2+} + 2e \rightarrow 2Hg$ | 0.79 |
| Silver | $Ag^+ + e \rightarrow Ag$ | 0.80 |
| Gold | $Au^{3+} + 3e \rightarrow Au$ | 1.50 |

Thus, as will be apparent, when the metal substrate comprises one of the materials listed earlier, such as cold rolled steel, hot rolled steel, steel coated with zinc metal, zinc compounds, or zinc alloys, hot-dipped galvanized steel, galvanealed steel, steel plated with zinc alloy, aluminum alloys, aluminum plated steel, aluminum alloy plated steel, magnesium and magnesium alloys, suitable electropositive metals for deposition thereon include, for example, nickel, copper, silver, and gold, as well mixtures thereof.

In certain embodiments in which the electropositive metal comprises copper, both soluble and insoluble compounds may serve as the source of copper in the pretreatment compositions. For example, the supplying source of copper ions in the pretreatment composition may be a water soluble copper compound. Specific examples of such materials include, but are not limited to, copper cyanide, copper potassium cyanide, copper sulfate, copper nitrate, copper pyrophosphate, copper thiocyanate, disodium copper ethylenediaminetetraacetate tetrahydrate, copper bromide, copper oxide, copper hydroxide, copper chloride, copper fluoride, copper gluconate, copper citrate, copper lauroyl sarcosinate, copper formate, copper acetate, copper propionate, copper butyrate, copper lactate, copper oxalate, copper phytate, copper tartarate, copper malate, copper succinate, copper malonate, copper maleate, copper benzoate, copper salicylate, copper aspartate, copper glutamate, copper fumarate, copper glycerophosphate, sodium copper chlorophyllin, copper fluorosilicate, copper fluoroborate and copper iodate, as well as copper salts of carboxylic acids in the homologous series formic acid to decanoic acid, copper salts of polybasic acids in the series oxalic acid to suberic acid, and copper salts of hydroxycarboxylic acids, including glycolic, lactic, tartaric, malic and citric acids.

When copper ions supplied from such a water-soluble copper compound are precipitated as an impurity in the form of copper sulfate, copper oxide, etc., it may be desirable to add a complexing agent that suppresses the precipitation of copper ions, thus stabilizing them as a copper complex in the solution.

In certain embodiments, the copper compound is added as a copper complex salt such as $K_3Cu(CN)_4$ or Cu-EDTA, which can be present stably in the pretreatment composition on its own, but it is also possible to form a copper complex that can be present stably in the pretreatment composition by combining a complexing agent with a compound that is difficultly soluble on its own. Examples thereof include a copper cyanide complex formed by a combination of CuCN and KCN or a combination of CuSCN and KSCN or KCN, and a Cu-EDTA complex formed by a combination of $CuSO_4$ and EDTA.2Na.

With regard to the complexing agent, a compound that can form a complex with copper ions can be used; examples thereof include inorganic compounds such as cyanide compounds and thiocyanate compounds, and polycarboxylic acids, and specific examples thereof include ethylenediaminetetraacetic acid, salts of ethylenediaminetetraacetic acid such as dihydrogen disodium ethylenediaminetetraacetate dihydrate, aminocarboxylic acids such as nitrilotriacetic acid and iminodiacetic acid, oxycarboxylic acids such as citric acid and tartaric acid, succinic acid, oxalic acid, ethylenediaminetetramethylenephosphonic acid, and glycine.

In certain embodiments, the electropositive metal is present in the pretreatment composition in an amount of less than 100 ppm, such as 1 or 2 ppm to 35 or 40 ppm, based on the total weight of all of the ingredients in the pretreatment composition. The amount of electropositive metal in the pretreatment composition can range between the recited values inclusive of the recited values.

In certain embodiments, the pretreatment compositions may also comprise molybdenum. In certain embodiments, the source of molybdenum used in the pretreatment composition is in the form of a salt. Suitable molybdenum salts are sodium molybdate, calcium molybdate, potassium molybdate, ammonium molybdate, molybdenum chloride, molybdenum acetate, molybdenum sulfamate, molybdenum formate, or molybdenum lactate.

In certain embodiments, the molybdenum is present in the pretreatment composition in an amount of 5 to 500 ppm, such as 5 to 150 ppm, based on the total weight of the ingredients in the pretreatment composition. The amount of molybdenum in the pretreatment composition can range between the recited values inclusive of the recited values.

In certain embodiments, the pH of the pretreatment composition ranges from 1 to 6, such as from 2 to 5.5. The pH of the pretreatment composition may be adjusted using, for example, any acid or base as is necessary. In certain embodiments, the pH of the solution is maintained through the inclusion of a basic material, including water soluble and/or water dispersible bases, such as sodium hydroxide, sodium carbonate, potassium hydroxide, ammonium hydroxide, ammonia, and/or amines such as triethylamine, methylethyl amine, or mixtures thereof.

In certain embodiments, the pretreatment composition also may comprise a resinous binder. Suitable resins include reaction products of one or more alkanolamines and an epoxy-functional material containing at least two epoxy groups, such as those disclosed in U.S. Pat. No. 5,653,823. In some cases, such resins contain beta hydroxy ester, imide, or sulfide functionality, incorporated by using dimethylolpropionic acid, phthalimide, or mercaptoglycerine as an additional reactant in the preparation of the resin. Alternatively, the reaction product is that of the diglycidyl ether of Bisphenol A (commercially available from Shell Chemical Company as EPON 880), dimethylol propionic acid, and diethanolamine in a 0.6 to 5.0:0.05 to 5.5:1 mole ratio. Other suitable resinous binders include water soluble and water dispersible polyacrylic acids as disclosed in U.S. Pat. Nos. 3,912,548 and 5,328,525; phenol formaldehyde resins as described in U.S. Pat. No. 5,662,746; water soluble polyamides such as those disclosed in WO 95/33869; copolymers of maleic or acrylic acid with allyl ether as described in Canadian patent application 2,087,352; and water soluble and dispersible resins including epoxy resins, aminoplasts, phenol-formaldehyde resins, tannins, and polyvinyl phenols as discussed in U.S. Pat. No. 5,449,415.

In these embodiments of the present invention, the resinous binder often may be present in the pretreatment composition in an amount of 0.005 percent to 30 percent by weight, such as 0.5 to 3 percent by weight, based on the total weight of the ingredients in the composition.

In other embodiments, however, the pretreatment composition may be substantially free or, in some cases, completely free of any resinous binder. As used herein, the term "substantially free", when used with reference to the absence of resinous binder in the pretreatment composition, means that any resinous binder is present in the pretreatment composition in a trace amount of less than 0.005 percent by weight. As used herein, the term "completely free" means that there is no resinous binder in the pretreatment composition at all.

The pretreatment composition may optionally contain other materials such as nonionic surfactants and auxiliaries conventionally used in the art of pretreatment. In an aqueous medium, water dispersible organic solvents, for example, alcohols with up to about 8 carbon atoms such as methanol, isopropanol, and the like, may be present; or glycol ethers such as the monoalkyl ethers of ethylene glycol, diethylene glycol, or propylene glycol, and the like. When present, water dispersible organic solvents are typically used in amounts up to about ten percent by volume, based on the total volume of aqueous medium.

Other optional materials include surfactants that function as defoamers or substrate wetting agents. Anionic, cationic, amphoteric, and/or nonionic surfactants may be used. Defoaming surfactants are often present at levels up to 1 weight percent, such as up to 0.1 percent by weight, and wetting agents are typically present at levels up to 2 percent, such as up to 0.5 percent by weight, based on the total weight of the pretreatment composition.

In certain embodiments, the pretreatment composition also may comprise a silane, such as, for example, an amino group-containing silane coupling agent, a hydrolysate thereof, or a polymer thereof, as described in United States Patent Application Publication No. 2004/0163736 A1 at [0025] to [0031], the cited portion of which being incorporated herein by reference. In other embodiments of the present invention, however, the pretreatment composition is substantially free, or, in some cases, completely free of any such amino group-containing silane coupling agent. As used herein, the term "substantially free", when used with reference to the absence of amino-group containing silane coupling agent in the pretreatment composition, means that any amino-group containing silane coupling agent, hydrolysate thereof, or polymer thereof that is present in the pretreatment composition is present in a trace amount of less than 5 ppm. As used herein, the term "completely free" means that there is no amino-group containing silane coupling agent, hydrolysate thereof, or polymer thereof in the pretreatment composition at all.

In certain embodiments, the pretreatment composition also may comprise a reaction accelerator, such as nitrite ions, nitro-group containing compounds, hydroxylamine sulfate, persulfate ions, sulfite ions, hyposulfite ions, peroxides, iron (III) ions, citric acid iron compounds, bromate ions, perchlorinate ions, chlorate ions, chlorite ions as well as ascorbic acid, citric acid, tartaric acid, malonic acid, succinic acid and salts thereof. Specific examples of suitable materials and their amounts are described in United States Patent Application Publication No. 2004/0163736 A1 at [0032] to [0041], the cited portion of which being incorporated herein by reference.

In certain embodiments, the pretreatment composition is substantially or, in some cases, completely free of phosphate ions. As used herein, the term "substantially free," when used in reference to the absence of phosphate ions in the pretreatment composition, means that phosphate ions are not present in the composition to such an extent that the phosphate ions cause a burden on the environment. For example, phosphate ions may be present in the pretreatment composition in a trace amount of less than 10 ppm. That is, phosphate ions are not substantially used and the formation of sludge, such as iron phosphate and zinc phosphate, formed in the case of using a treating agent based on zinc phosphate, is eliminated.

In certain embodiments, the pretreatment composition also may include a source of phosphate ions. For example, phosphate ions may be added in an amount of greater than 10 ppm up to 60 ppm, such as for example 20 ppm to 40 ppm or for example 30 ppm.

In certain embodiments, the pretreatment composition is substantially, or in some cases, completely free of chromate. As used herein, the term "substantially free," when used in reference to the absence of chromate in the pretreatment composition, means that any chromate is present in the pretreatment composition in a trace amount of less than 5 ppm. As used herein, the term "completely free," when used in reference to the absence of chromate in the pretreatment composition, means that there is no chromate in the pretreatment composition at all.

In certain embodiments, the film coverage of the residue of the pretreatment coating composition generally ranges from 1 to 1000 milligrams per square meter ($mg/m^2$), for example, from 10 to 400 $mg/m^2$. In certain embodiments, the thickness of the pretreatment coating may be less than 1 micrometer, for example from 1 to 500 nanometers, or from 10 to 300 nanometers. Following contact with the pretreatment solution, the substrate optionally may be rinsed with water and dried. In certain embodiments, the substrate may be dried for 0.5 to 30 minutes in an oven at 15 to 200° C. (60 to 400 ° F.), such as for 10 minutes at 70° F.

Optionally, after the pretreatment step, the substrate may then be contacted with a post-rinse solution. Post-rinse solutions, in general, utilize certain solubilized metal ions or other inorganic materials (such as phosphates or simple or complex fluorides) to enhance the corrosion protection of pretreated metal substrates. These post-rinse solutions may be chrome containing or non-chrome containing post-rinse solutions. Suitable non-chrome post-rinse solutions that may be utilized in the present invention are disclosed in U.S. Pat. Nos. 5,653,823; 5,209,788; and 5,149,382; all assigned to PPG Industries, Inc. and herein incorporated by reference. In addition, organic materials (resinous or otherwise) such as phosphitized epoxies, base-solubilized, carboxylic acid containing polymers, at least partially neutralized interpolymers of hydroxyl-alkyl esters of unsaturated carboxylic acids, and amine salt-group containing resins (such as acid-solubilized reaction products of polyepoxides and primary or secondary amines) may also be utilized alone or in combination with solubilized metal ions and/or other inorganic materials. After the optional post-rinse (when utilized), the substrate may be rinsed with water prior to subsequent processing.

In certain embodiments of the methods of the present invention, after the substrate is contacted with the pretreatment composition, it then may be contacted with a coating composition comprising a film-forming resin. Any suitable technique may be used to contact the substrate with such a coating composition, including, for example, brushing, dipping, flow coating, spraying and the like. In certain embodiments, however, as described in more detail below, such contacting comprises an electrocoating step wherein an electrodepositable composition is deposited onto the metal substrate by electrodeposition.

As used herein, the term "film-forming resin" refers to resins that can form a self-supporting continuous film on at least a horizontal surface of a substrate upon removal of any diluents or carriers present in the composition or upon curing at ambient or elevated temperature. Conventional film-forming resins that may be used include, without limitation, those typically used in automotive OEM coating compositions, automotive refinish coating compositions, industrial coating compositions, architectural coating compositions, coil coating compositions, and aerospace coating compositions, among others.

In certain embodiments, the coating composition comprises a thermosetting film-forming resin. As used herein, the term "thermosetting" refers to resins that "set" irreversibly upon curing or crosslinking, wherein the polymer chains of the polymeric components are joined together by covalent bonds. This property is usually associated with a cross-linking reaction of the composition constituents often induced, for example, by heat or radiation. Curing or crosslinking reactions also may be carried out under ambient conditions. Once cured or crosslinked, a thermosetting resin will not melt upon the application of heat and is insoluble in solvents. In other embodiments, the coating composition comprises a thermoplastic film-forming resin. As used herein, the term "thermoplastic" refers to resins that comprise polymeric components that are not joined by covalent bonds and thereby can undergo liquid flow upon heating and are soluble in solvents.

As previously indicated, in certain embodiments, the substrate is contacted with a coating composition comprising a film-forming resin by an electrocoating step wherein an electrodepositable composition is deposited onto the metal substrate by electrodeposition. In the process of electrodeposition, the metal substrate being treated, serving as an electrode, and an electrically conductive counter electrode are placed in contact with an ionic, electrodepositable composition. Upon passage of an electric current between the electrode and counter electrode while they are in contact with the electrodepositable composition, an adherent film of the electrodepositable composition will deposit in a substantially continuous manner on the metal substrate.

Electrodeposition is usually carried out at a constant voltage in the range of from 1 volt to several thousand volts, typically between 50 and 500 volts. Current density is usually between 1.0 ampere and 15 amperes per square foot (10.8 to 161.5 amperes per square meter) and tends to decrease quickly during the electrodeposition process, indicating formation of a continuous self-insulating film.

The electrodepositable composition utilized in certain embodiments of the present invention often comprises a resinous phase dispersed in an aqueous medium wherein the resinous phase comprises: (a) an active hydrogen group-containing ionic electrodepositable resin, and (b) a curing agent having functional groups reactive with the active hydrogen groups of (a).

In certain embodiments, the electrodepositable compositions utilized in certain embodiments of the present invention contain, as a main film-forming polymer, an active hydrogen-containing ionic, often cationic, electrodepositable resin. A wide variety of electrodepositable film-forming resins are known and can be used in the present invention so long as the polymers are "water dispersible," i.e., adapted to be solubilized, dispersed or emulsified in water. The water dispersible polymer is ionic in nature, that is, the polymer will contain anionic functional groups to impart a negative charge or, as is often preferred, cationic functional groups to impart a positive charge.

Examples of film-forming resins suitable for use in anionic electrodepositable compositions are base-solubilized, carboxylic acid containing polymers, such as the reaction product or adduct of a drying oil or semi-drying fatty acid ester with a dicarboxylic acid or anhydride; and the reaction product of a fatty acid ester, unsaturated acid or anhydride and any additional unsaturated modifying materials which are further reacted with polyol. Also suitable are the at least partially neutralized interpolymers of hydroxyalkyl esters of unsaturated carboxylic acids, unsaturated carboxylic acid and at least one other ethylenically unsaturated monomer. Still another suitable electrodepositable film-forming resin comprises an alkyd-aminoplast vehicle, i.e., a vehicle containing an alkyd resin and an amine-aldehyde resin. Yet another anionic electrodepositable resin composition comprises mixed esters of a resinous polyol, such as is described in U.S. Pat. No. 3,749,657 at col. 9, lines 1 to 75 and col. 10, lines 1 to 13, the cited portion of which being incorporated herein by reference. Other acid functional polymers can also be used, such as phosphatized polyepoxide or phosphatized acrylic polymers as are known to those skilled in the art.

As aforementioned, it is often desirable that the active hydrogen-containing ionic electrodepositable resin (a) is cationic and capable of deposition on a cathode. Examples of such cationic film-forming resins include amine salt group-containing resins, such as the acid-solubilized reaction products of polyepoxides and primary or secondary amines, such as those described in U.S. Pat. Nos. 3,663,389; 3,984,299; 3,947,338; and 3,947,339. Often, these amine salt group-containing resins are used in combination with a blocked isocyanate curing agent. The isocyanate can be fully blocked, as described in U.S. Pat. No. 3,984,299, or the isocyanate can be partially blocked and reacted with the resin backbone, such as is described in U.S. Pat. No. 3,947,338. Also, one-component compositions as described in U.S. Pat. No. 4,134,866 and DE-OS No. 2,707,405 can be used as the film-forming resin. Besides the epoxy-amine reaction products, film-forming resins can also be selected from cationic acrylic resins, such as those described in U.S. Pat. Nos. 3,455,806 and 3,928,157.

Besides amine salt group-containing resins, quaternary ammonium salt group-containing resins can also be employed, such as those formed from reacting an organic polyepoxide with a tertiary amine salt as described in U.S. Pat. Nos. 3,962,165; 3,975,346; and 4,001,101. Examples of other cationic resins are ternary sulfonium salt group-containing resins and quaternary phosphonium salt-group containing resins, such as those described in U.S. Pat. Nos. 3,793,278 and 3,984,922, respectively. Also, film-forming resins which cure via transesterification, such as described in European Application No. 12463 can be used. Further, cationic compositions prepared from Mannich bases, such as described in U.S. Pat. No. 4,134,932, can be used.

In certain embodiments, the resins present in the electrodepositable composition are positively charged resins which contain primary and/or secondary amine groups, such as described in U.S. Pat. Nos. 3,663,389; 3,947,339; and 4,116,900. In U.S. Pat. No. 3,947,339, a polyketimine derivative of a polyamine, such as diethylenetriamine or triethylenetetraamine, is reacted with a polyepoxide. When the reaction product is neutralized with acid and dispersed in water, free primary amine groups are generated. Also, equivalent products are formed when polyepoxide is reacted with excess polyamines, such as diethylenetriamine and triethylenetetraamine, and the excess polyamine vacuum stripped from the reaction mixture, as described in U.S. Pat. Nos. 3,663,389 and 4,116,900.

In certain embodiments, the active hydrogen-containing ionic electrodepositable resin is present in the electrodepositable composition in an amount of 1 to 60 percent by weight, such as 5 to 25 percent by weight, based on total weight of the electrodeposition bath.

As indicated, the resinous phase of the electrodepositable composition often further comprises a curing agent adapted to react with the active hydrogen groups of the ionic electrodepositable resin. For example, both blocked organic polyisocyanate and aminoplast curing agents are suitable for use in the present invention, although blocked isocyanates are often preferred for cathodic electrodeposition.

Aminoplast resins, which are often the preferred curing agent for anionic electrodeposition, are the condensation products of amines or amides with aldehydes. Examples of suitable amine or amides are melamine, benzoguanamine, urea and similar compounds. Generally, the aldehyde employed is formaldehyde, although products can be made from other aldehydes, such as acetaldehyde and furfural. The condensation products contain methylol groups or similar alkylol groups depending on the particular aldehyde employed. Often, these methylol groups are etherified by reaction with an alcohol, such as a monohydric alcohol containing from 1 to 4 carbon atoms, such as methanol, ethanol, isopropanol, and n-butanol. Aminoplast resins are commercially available from American Cyanamid Co. under the trademark CYMEL and from Monsanto Chemical Co. under the trademark RESIMENE.

The aminoplast curing agents are often utilized in conjunction with the active hydrogen containing anionic electrodepositable resin in amounts ranging from 5 percent to 60 percent by weight, such as from 20 percent to 40 percent by weight, the percentages based on the total weight of the resin solids in the electrodepositable composition. As indicated, blocked organic polyisocyanates are often used as the curing agent in cathodic electrodeposition compositions. The polyisocyanates can be fully blocked as described in U.S. Pat. No. 3,984,299 at col. 1, lines 1 to 68, col. 2, and col. 3, lines 1 to 15, or partially blocked and reacted with the polymer backbone as described in U.S. Pat. No. 3,947,338 at col. 2, lines 65 to 68, col. 3, and col. 4 lines 1 to 30, the cited portions of which being incorporated herein by reference. By "blocked" is meant that the isocyanate groups have been reacted with a compound so that the resultant blocked isocyanate group is stable to active hydrogens at ambient temperature but reactive with active hydrogens in the film forming polymer at elevated temperatures usually between 90° C. and 200° C.

Suitable polyisocyanates include aromatic and aliphatic polyisocyanates, including cycloaliphatic polyisocyanates and representative examples include diphenylmethane-4,4'-diisocyanate (MDI), 2,4- or 2,6-toluene diisocyanate (TDI), including mixtures thereof, p-phenylene diisocyanate, tetramethylene and hexamethylene diisocyanates, dicyclohexylmethane-4,4'-diisocyanate, isophorone diisocyanate, mixtures of phenylmethane-4,4'-diisocyanate and polymethylene polyphenylisocyanate. Higher polyisocyanates, such as triisocyanates can be used. An example would include triphenylmethane-4,4',4"-triisocyanate. Isocyanate ( )-prepolymers with polyols such as neopentyl glycol and trimethylolpropane and with polymeric polyols such as polycaprolactone diols and triols (NCO/OH equivalent ratio greater than 1) can also be used.

The polyisocyanate curing agents are typically utilized in conjunction with the active hydrogen containing cationic electrodepositable resin in amounts ranging from 5 percent to 60 percent by weight, such as from 20 percent to 50 percent by weight, the percentages based on the total weight of the resin solids of the electrodepositable composition.

In certain embodiments, the coating composition comprising a film-forming resin also comprises yttrium. In certain embodiments, yttrium is present in such compositions in an amount from 10 to 10,000 ppm, such as not more than 5,000 ppm, and, in some cases, not more than 1,000 ppm, of total yttrium (measured as elemental yttrium). Both soluble and insoluble yttrium compounds may serve as the source of yttrium. Examples of yttrium sources suitable for use in lead-free electrodepositable coating compositions are soluble organic and inorganic yttrium salts such as yttrium acetate, yttrium chloride, yttrium formate, yttrium carbonate, yttrium sulfamate, yttrium lactate and yttrium nitrate. When the yttrium is to be added to an electrocoat bath as an aqueous solution, yttrium nitrate, a readily available yttrium compound, is a preferred yttrium source. Other yttrium compounds suitable for use in electrodepositable compositions are organic and inorganic yttrium compounds such as yttrium oxide, yttrium bromide, yttrium hydroxide, yttrium molybdate, yttrium sulfate, yttrium silicate, and yttrium oxalate. Organoyttrium complexes and yttrium metal can also be used. When the yttrium is to be incorporated into an electrocoat bath as a component in the pigment paste, yttrium oxide is often the preferred source of yttrium.

The electrodepositable compositions described herein are in the form of an aqueous dispersion. The term "dispersion" is believed to be a two-phase transparent, translucent or opaque resinous system in which the resin is in the dispersed phase and the water is in the continuous phase. The average particle size of the resinous phase is generally less than 1.0 and usually less than 0.5 microns, often less than 0.15 micron.

The concentration of the resinous phase in the aqueous medium is often at least 1 percent by weight, such as from 2 to 60 percent by weight, based on total weight of the aqueous dispersion. When such compositions are in the form of resin concentrates, they generally have a resin solids content of 20 to 60 percent by weight based on weight of the aqueous dispersion.

The electrodepositable compositions described herein are often supplied as two components: (1) a clear resin feed, which includes generally the active hydrogen-containing ionic electrodepositable resin, i.e., the main film-forming polymer, the curing agent, and any additional water-dispersible, non-pigmented components; and (2) a pigment paste, which generally includes one or more colorants (described below), a water-dispersible grind resin which can be the same or different from the main-film forming polymer, and, optionally, additives such as wetting or dispersing aids. Electrodeposition bath components (1) and (2) are dispersed in an aqueous medium which comprises water and, usually, coalescing solvents.

As aforementioned, besides water, the aqueous medium may contain a coalescing solvent. Useful coalescing solvents are often hydrocarbons, alcohols, esters, ethers and ketones. The preferred coalescing solvents are often alcohols, polyols and ketones. Specific coalescing solvents include isopropanol, butanol, 2-ethylhexanol, isophorone, 2-methoxypentanone, ethylene and propylene glycol and the monoethyl monobutyl and monohexyl ethers of ethylene glycol. The amount of coalescing solvent is generally between 0.01 and 25 percent, such as from 0.05 to 5 percent by weight based on total weight of the aqueous medium.

In addition, a colorant and, if desired, various additives such as surfactants, wetting agents or catalyst can be included in the coating composition comprising a film-forming resin. As used herein, the term "colorant" means any substance that imparts color and/or other opacity and/or other visual effect to the composition. The colorant can be added to the composition in any suitable form, such as discrete particles, dispersions, solutions and/or flakes. A single colorant or a mixture of two or more colorants can be used.

Example colorants include pigments, dyes and tints, such as those used in the paint industry and/or listed in the Dry Color Manufacturers Association (DCMA), as well as special effect compositions. A colorant may include, for example, a finely divided solid powder that is insoluble but wettable under the conditions of use. A colorant can be organic or inorganic and can be agglomerated or non-agglomerated. Colorants can be incorporated by use of a grind vehicle, such as an acrylic grind vehicle, the use of which will be familiar to one skilled in the art.

Example pigments and/or pigment compositions include, but are not limited to, carbazole dioxazine crude pigment, azo, monoazo, disazo, naphthol AS, salt type (lakes), benzimidazolone, condensation, metal complex, isoindolinone, isoindoline and polycyclic phthalocyanine, quinacridone, perylene, perinone, diketopyrrolo pyrrole, thioindigo, anthraquinone, indanthrone, anthrapyrimidine, flavanthrone, pyranthrone, anthanthrone, dioxazine, triarylcarbonium, quinophthalone pigments, diketo pyrrolo pyrrole red ("DPPBO red"), titanium dioxide, carbon black and mixtures thereof. The terms "pigment" and "colored filler" can be used interchangeably.

Example dyes include, but are not limited to, those that are solvent and/or aqueous based such as phthalo green or blue, iron oxide, bismuth vanadate, anthraquinone, perylene, aluminum and quinacridone.

Example tints include, but are not limited to, pigments dispersed in water-based or water miscible carriers such as AQUA-CHEM 896 commercially available from Degussa, Inc., CHARISMA COLORANTS and MAXITONER INDUSTRIAL COLORANTS commercially available from Accurate Dispersions division of Eastman Chemical, Inc.

As noted above, the colorant can be in the form of a dispersion including, but not limited to, a nanoparticle dispersion. Nanoparticle dispersions can include one or more highly dispersed nanoparticle colorants and/or colorant particles that produce a desired visible color and/or opacity and/or visual effect. Nanoparticle dispersions can include colorants such as pigments or dyes having a particle size of less than 150 nm, such as less than 70 nm, or less than 30 nm. Nanoparticles can be produced by milling stock organic or inorganic pigments with grinding media having a particle size of less than 0.5 mm. Example nanoparticle dispersions and methods for making them are identified in U.S. Pat. No. 6,875,800 B2, which is incorporated herein by reference. Nanoparticle dispersions can also be produced by crystallization, precipitation, gas phase condensation, and chemical attrition (i.e., partial dissolution). In order to minimize re-agglomeration of nanoparticles within the coating, a dispersion of resin-coated nanoparticles can be used. As used herein, a "dispersion of resin-coated nanoparticles" refers to a continuous phase in which is dispersed discreet "composite microparticles" that comprise a nanoparticle and a resin coating on the nanoparticle. Example dispersions of resin-coated nanoparticles and methods for making them are identified in United States Patent Application Publication 2005-0287348 A1, filed Jun. 24, 2004, U.S. Provisional Application No. 60/482,167 filed Jun. 24, 2003, and U.S. patent application Ser. No. 11/337,062, filed Jan. 20, 2006, which is also incorporated herein by reference.

Example special effect compositions that may be used include pigments and/or compositions that produce one or more appearance effects such as reflectance, pearlescence, metallic sheen, phosphorescence, fluorescence, photochromism, photosensitivity, thermochromism, goniochromism and/or color-change. Additional special effect compositions can provide other perceptible properties, such as opacity or texture. In certain embodiments, special effect compositions can produce a color shift, such that the color of the coating changes when the coating is viewed at different angles. Example color effect compositions are identified in U.S. Pat. No. 6,894,086, incorporated herein by reference. Additional color effect compositions can include transparent coated mica and/or synthetic mica, coated silica, coated alumina, a transparent liquid crystal pigment, a liquid crystal coating, and/or any composition wherein interference results from a refractive index differential within the material and not because of the refractive index differential between the surface of the material and the air.

In certain embodiments, a photosensitive composition and/or photochromic composition, which reversibly alters its color when exposed to one or more light sources, can be used. Photochromic and/or photosensitive compositions can be activated by exposure to radiation of a specified wavelength. When the composition becomes excited, the molecular structure is changed and the altered structure exhibits a new color that is different from the original color of the composition. When the exposure to radiation is removed, the photochromic and/or photosensitive composition can return to a state of rest, in which the original color of the composition returns. In certain embodiments, the photochromic and/or photosensitive composition can be colorless in a non-excited state and exhibit a color in an excited state. Full color-change can appear within milliseconds to several minutes, such as from 20 seconds to 60 seconds. Example photochromic and/or photosensitive compositions include photochromic dyes.

In certain embodiments, the photosensitive composition and/or photochromic composition can be associated with and/or at least partially bound to, such as by covalent bonding, a polymer and/or polymeric materials of a polymerizable component. In contrast to some coatings in which the photosensitive composition may migrate out of the coating and crystallize into the substrate, the photosensitive composition and/or photochromic composition associated with and/or at least partially bound to a polymer and/or polymerizable component in accordance with certain embodiments of the present invention, have minimal migration out of the coating. Example photosensitive compositions and/or photochromic compositions and methods for making them are identified in U.S. application Ser. No. 10/892,919 filed Jul. 16, 2004, incorporated herein by reference.

In general, the colorant can be present in the coating composition in any amount sufficient to impart the desired visual and/or color effect. The colorant may comprise from 1 to 65 weight percent, such as from 3 to 40 weight percent or 5 to 35 weight percent, with weight percent based on the total weight of the composition.

After deposition, the coating is often heated to cure the deposited composition. The heating or curing operation is often carried out at a temperature in the range of from 120 to 250° C., such as from 120 to 190° C., for a period of time ranging from 10 to 60 minutes. In certain embodiments, the thickness of the resultant film is from 10 to 50 microns.

As will be appreciated by the foregoing description, the present invention is directed to compositions for treating a metal substrate. These compositions comprise: a Group IIIB and/or Group IVB metal; free fluoride; and lithium. The composition, in certain embodiments, is substantially free of heavy metal phosphate, such as zinc phosphate and nickel-containing phosphate, and chromate.

As has been indicated throughout the foregoing description, the methods and coated substrates of the present invention do not, in certain embodiments, include the deposition of a crystalline phosphate, such as zinc phosphate, or a chromate. As a result, the environmental drawbacks associated with such materials can be avoided. Nevertheless, the methods of the present invention have been shown to provide coated substrates that are, in at least some cases, resistant to corrosion at a level comparable to, in some cases even superior to, methods wherein such materials are used. This is a surprising and unexpected discovery of the present invention and satisfies a long felt need in the art.

Illustrating the invention are the following examples that are not to be considered as limiting the invention to their details. All parts and percentages in the examples, as well as throughout the specification, are by weight unless otherwise indicated.

EXAMPLE 1

Twelve cold rolled steel (CRS) panels (panels 1-12) were cleaned by dipping with a solution of Chemkleen 166 M/Chemkleen 171/11, a two component liquid alkaline cleaner available from PPG Industries, for three minutes at 60° C. After alkaline cleaning, the panels were rinsed thoroughly with deionized water and then with deionized water containing 0.25 g/l Zirco Rinse Additive (available commercially from PPG Industries, Quattordio, Italy).

Six of these panels (panels 1-6) were immersed in a zirconium pretreatment solution for two minutes at ambient temperature, designated in Tables 2 and 3 as "Pretreatment A." Pretreatment A was prepared by diluting 4.5 liters Zircobond ZC (a hexafluorozirconic acid copper containing agent available commercially from PPG Industries, Quattordio, Italy) with approximately 400 liters of deionized water to a zirconium concentration of 175 ppm (as zirconium) and adjusting the pH to 4.5 with Chemfill Buffer/M (a mild alkaline buffering agent available commercially from PPG Industries, Quattordio, Italy).

After pretreatment in a solution of Pretreatment A, panels 1-6 were rinsed with deionized water containing 0.25 g/l Zirco Rinse Additive, then were thoroughly rinsed with deionized water, and then were dried for 10 minutes in an oven at 70° C. Panels 1-6 had a light bronze appearance and the coating thickness was measured using a portable X-ray Fluorescence instrument (XRF) at approximately 39 nm.

The pretreatment solution referred to in Table 2 as "Pretreatment B" was prepared by adding 1 g/l lithium nitrate (available from Sigma Aldrich code 227986) to Pretreatment A solution in order to obtain a concentration of 100 ppm lithium. Each panel was dried by placing it in an oven at 70° C. for approximately ten minutes. The coating thickness as measured by XRF was approximately 39 nm.

All of the panels that were pretreated with either Pretreatment A or Pretreatment B were subsequently coated with G6MC2, a yttrium-containing cathodic electrocoat commercially available from PPG Industries that contains 422 g of resin (W7827, commercially available from PPG Industries, Inc.), 98 g of paste (P9757, commercially available from PPG Industries, Inc.), and 480 g of water. The G6MC3 coating bath was prepared and coated according to the manufacturer's instructions. The panels were cured according to the manufacturer's specifications.

After curing, three of the coated panels pretreated with Pretreatment A and three of the coated panels pretreated with Pretreatment B were subjected to a VW cyclic corrosion test PV1210. After a scribe and a first stone chipping, the three coated panels pretreated with Pretreatment A and the three panels pretreated with Pretreatment B were exposed to condensing humidity (4 hours NSS at 35° C. then 4 hours at 23° C. and 50% humidity followed by 16 hours at 40° C. and 100% humidity) for 30 days, and then a second VW cyclic corrosion PV1210 test was run on the exposed panels. The stone chipping results were rated on a scale of 0 to 5, where 5 indicates complete paint loss, and 0 indicates perfect paint adhesion. After humidity exposure, the corrosion creepage along the scribe and stone chipping results were measured.

The remaining three coated panels pretreated with Pretreatment A and the remaining three coated panels pretreated with Pretreatment B were subjected to a GM cyclic corrosion test in which the panels were scratched by cutting through the coating system down to metal. The panels were exposed to condensing humidity (8 hours at 25° C. and 45% humidity then 8 hours at 49° C. and 100% humidity followed by 8 hours at 60° C. and 30% humidity) for 40 days. At the end of the test, the panels were rated by measuring the paint loss from the scribe (creep) and the maximum creepage (both sides) calculated in millimeters for each panel. Results are summarized in Table 2 below.

The film on the panels pretreated with Pretreatment B were tested using Time-of-Flight Secondary Ion Mass Spectrometry (ToF-SIMS), which indicated that the film consists of zirconium, oxygen, fluoride, and lithium. Lithium was present throughout the film.

TABLE 2

| | | 28 cycles GMW | 30 cycles VW PV1210 test | |
|---|---|---|---|---|
| Pretreatment | Electrocoat | 14872 test Corrosion along the scribe (mm) | Corrosion along the scribe (mm) | Stone chipping creepage rating[ |
| A | G6MC3 | 9.5 | 1.2 | 4.0 |
| B | G6MC3 | 6.3 | 0.8 | 3.0 |

EXAMPLE 2

Cold rolled steel panels were pretreated as in Example 1, with half of the panels being pretreated with Pretreatment A and the other half being pretreated with "Pretreatment C," where Pretreatment C was prepared by adding lithium nitrate and sodium molybdenum to Pretreatment A in order to obtain a concentration of 40 ppm molybdenum and 100 ppm lithium. Each panel was dried by placing it in an oven at 70° C. for approximately ten minutes. The coating thickness as measured by XRF was approximately 40 nm.

The panels were subsequently electrocoated with ED 6070/2, a yttrium-containing cathodic electrocoat commercially available from PPG Industries that contains 472 g of resin (W7910, commercially available from PPG Industries, Inc.), 80 g of paste (P9711, commercially available from PPG Industries, Inc.), and 448 g of water. The panels were subjected to the VW cyclic corrosion test PV1210. The results appear in Table 3 below.

The film on the panels pretreated with Pretreatment C was tested using ToF-SIMS, X-Ray Photoelectron Spectroscopy (XPS), and X-Ray Fluorescence Spectroscopy (XRF). ToF-SIMS indicated the presence of lithium and molybdenum throughout the coating and that molybdenum was present in the mixed oxide form. XPS and XRF confirmed the presence of molybdenum at 1-10% of the zirconium oxide film weight. Zirconium, oxygen, fluoride, lithium, and molybdenum were present in the film.

TABLE 3

| | | 30 cycles VW PV1210 test | |
|---|---|---|---|
| Pretreatment | Electrocoat | Corrosion along the scribe (mm) | Stone chipping creepage rating |
| A | ED6070/2 | 0.75 | 2.5 |
| C | ED6070/2 | 0.5 | 2 |

It will be appreciated by those skilled in the art that changes could be made to the embodiments described above without departing from the broad inventive concept thereof. It is understood, therefore, that this invention is not limited to the particular embodiments disclosed, but it is intended to cover modifications which are within the spirit and scope of the invention, as defined by the appended claims.

What is claimed is:

1. A pretreatment composition for treating a metal substrate comprising:

a first compound comprising a Group IIIB and/or Group IVB metal;

free fluoride; and a second compound comprising lithium nitrate;

wherein a molar ratio of the Group IIIB and/or Group IVB metal to the lithium is 100:1 to 1:10; and wherein lithium is present in the pretreatment composition in an amount of 25ppm to 125 ppm based on total weight of the ingredients of the pretreatment composition.

2. The pretreatment composition of claim 1, wherein the pretreatment composition comprises a Group IVB metal.

3. The pretreatment composition of claim 2, wherein the Group IVB metal comprises zirconium.

4. The pretreatment composition of claim 1, wherein the Group IVB metal comprises hexafluorozirconic acid, hexafluorotitanic acid, or salts thereof.

5. The pretreatment composition of claim 1, wherein the Group IVB metal comprises an oxide or hydroxide of zirconium.

6. The pretreatment composition of claim 1, wherein the Group IVB metal comprises zirconyl nitrate, zirconyl sulfate, or zirconium basic carbonate.

7. The pretreatment composition of claim 1, wherein the Group IIIB and/or Group IVB metal comprises an acid or salt.

8. The pretreatment composition of claim 1, wherein the Group IIIB and/or Group IVB metal comprises 50 parts per million to 500 parts per million metal, based on a total weight of the ingredients in the pretreatment composition.

9. The pretreatment composition of claim 1, wherein the Group IIIB and/or Group IVB metal comprises 75 parts per million to 250 parts per million metal, based on a total weight of the ingredients in the pretreatment composition.

10. The pretreatment composition of claim 1, wherein the free fluoride comprises from 5 ppm to 250 ppm of the pretreatment composition.

11. The pretreatment composition of claim 1, wherein the free fluoride comprises from 25 ppm to 200 ppm of the pretreatment composition.

12. The pretreatment composition of claim 1, wherein the pretreatment composition is substantially free of phosphate ions.

13. The pretreatment composition of claim 1, wherein the pretreatment composition is substantially free of chromate.

14. The pretreatment composition of claim 1, wherein the pretreatment composition is aqueous.

15. The pretreatment composition of claim 1, wherein the pretreatment composition is used in a dip application.

16. The pretreatment composition of claim 1, wherein the pretreatment composition is used in a spray application.

17. The pretreatment composition of claim 1, wherein a K ratio is equal to A/B, wherein A is a mole weight of a compound (A) containing the Group IIIB and/or Group IVB metal, and wherein B is a mole weight calculated as HF of a compound containing fluorine as a supplying source of the fluoride, wherein $K>0.10$.

18. The pretreatment composition of claim 1, wherein a K ratio is equal to A/B, wherein A is a mole weight of a compound (A) containing the Group IIIB and/or Group IVB metal, and wherein B is a mole weight calculated as HF of a compound containing fluorine as a supplying source of the fluoride, wherein $0.11<K<0.25$.

19. The pretreatment composition of claim 1, further comprising an electropositive metal.

20. The pretreatment composition of claim 19, wherein the electropositive metal is selected from the Group consisting of copper, nickel, silver, gold, and combinations thereof.

21. The pretreatment composition of claim 19, wherein the electropositive metal comprises copper.

22. The pretreatment composition of claim 21, wherein the copper comprises copper nitrate, copper sulfate, copper chloride, copper carbonate, or copper fluoride.

23. The pretreatment composition of claim 22, wherein the electropositive metal comprises up to 100 parts per million, based on a total weight of the ingredients in the pretreatment composition.

24. The pretreatment composition of claim 22, wherein the electropositive metal comprises 2 parts per million to 35 parts per million, based on a total weight of the ingredients in the pretreatment composition.

25. The pretreatment composition of claim 1, further comprising molybdenum.

26. The pretreatment composition of claim 25, wherein the molybdenum comprises a salt.

27. The pretreatment composition of claim 26, wherein the salt comprises sodium molybdate, calcium molybdate, potassium molybdate, ammonium molybdate, molybdenum chloride, molybdenum acetate, molybdenum sulfamate, molybdenum formate, or molybdenum lactate.

28. The pretreatment composition of claim 25, wherein the molybdenum comprises 5 parts per million to 500 parts per million, based on a total weight of the ingredients in the pretreatment composition.

29. The pretreatment composition of claim 25, wherein the molybdenum comprises 5 parts per million to 150 parts per million, based on a total weight of the ingredients in the pretreatment composition.

30. The pretreatment composition of claim 1, further comprising a resinous binder.

31. The pretreatment composition of claim 30, wherein the resinous binder is water soluble and/or dispersible.

32. The pretreatment composition of claim 30, wherein the resinous binder comprises a reaction product of one or more alkanolamines and an epoxy-functional material containing at least two epoxy groups, beta hydroxy ester, imide or sulfide functionality, polyamides, or combinations thereof.

33. The pretreatment composition of claim 1, further comprising an amine.

34. The pretreatment composition of claim 33, wherein the amine comprises trimethylamine, methylethyl amine, or mixtures thereof.

35. A method for treating a metal substrate comprising contacting the metal substrate with a pretreatment composition comprising a first compound comprising a Group IIIB and/or Group IVB metal, free fluoride, and a second compound comprising lithium nitrate, wherein a molar ratio of the Group IIIB and/or Group IVB metal to the lithium is 100:1 to 1:10, and wherein lithium is present in the pretreatment composition in an amount of 25 ppm to 125 ppm based on total weight of the ingredients in the pretreatment composition.

36. The method according to claim 35, wherein the pretreatment composition further comprises molybdenum.

37. The method according to claim 35, further comprising electrophoretically depositing a coating composition onto the metal substrate.

38. The method according to claim 37, wherein the coating composition comprises yttrium.

39. A method of coating a metal substrate comprising electrophoretically depositing a coating composition onto the metal substrate, wherein the metal substrate comprises a treated surface layer comprising a first compound comprising a Group IIIB and/or Group IVB metal, fluoride, and a second compound comprising lithium nitrate, wherein a molar ratio of the Group IIIB and/or Group IVB metal to the lithium is 100:1 and 1:10 , and wherein lithium is present in the pretreatment composition in an amount of 25 ppm to 125 ppm based on total weight of the ingredients in the pretreatment composition.

40. A pretreated metal substrate comprising a surface layer comprising a first compound comprising a Group IIIB and/or IVB metal, free fluoride, and a second compound comprising lithium nitrate on at least a portion of the substrate, wherein a molar ratio of the Group IIIB and/or Group IVB metal to the lithium is 100:1 to 1:10, and wherein lithium is present in the pretreatment composition in an amount of 25 ppm to 125 ppm based on total weight of the ingredients in the pretreatment composition.

41. An electrophoretically coated metal substrate comprising:

a treated surface layer comprising a first compound comprising a Group IIIB and/or Group IVB metal, fluoride, and a second compound comprising lithium nitrate on a surface of the metal substrate, wherein a molar ratio of the Group IIIB and/or Group IVB metal to the lithium is 100:1 to 1:10, and wherein lithium is present in the pretreatment composition in an amount of 25 ppm to 125 ppm based on total weight of the ingredients in the pretreatment composition; and an electrophoretically deposited coating over at least a portion of the treated surface layer.

* * * * *